United States Patent [19]

Sakai et al.

[11] Patent Number: 4,868,078

[45] Date of Patent: Sep. 19, 1989

[54] IMAGING MEMBER HAVING AN AMORPHOUS SILICON SURFACE LAYER

[75] Inventors: Eiichi Sakai, Niiza; Yuki Okuyama, Hino; Yoshihide Fujimaki; Toshinori Yamazaki, both of Hachioji; Satoru Ikeuchi, Hino, all of Japan

[73] Assignee: Konica Corporation, Tokyo, Japan

[21] Appl. No.: 139,642

[22] Filed: Dec. 30, 1987

[51] Int. Cl.[4] ..... G03G 5/14

[52] U.S. Cl. ..... 430/67; 430/65; 430/58

[58] Field of Search ..... 430/67, 66, 84, 95, 430/106.6, 65, 58

[56] References Cited

U.S. PATENT DOCUMENTS

| | | | |
|---|---|---|---|
| 4,614,698 | 9/1986 | Miyakawa et al. | 430/106.6 |
| 4,681,826 | 7/1987 | Fukatsu et al. | 430/67 |
| 4,738,914 | 4/1988 | Mizuno | 430/67 |

*Primary Examiner*—John L. Goodrow

*Attorney, Agent, or Firm*—Finnegan, Henderson, Farabow, Garrett, & Dunner

[57] ABSTRACT

An electrophotographic image forming method is disclosed. The method comprises the steps of developing an electrostatic image formed on an image-forming member with a particulate toner for forming a toner image and transferring said toner image onto a receiving material, in which the image-forming member has a surface-improving layer comprised principally of amorphous silicon, and the toner has a weight average particle size within the range of from 1 μm to 6 μm and contains a constituent having a weight average particle size of not more than 5 μm which accounts for not less than 20% by weight of the whole amount of the toner. An electrophotographic copy bearing a high-resolution and high-quality image can be stably obtained by this method.

24 Claims, 2 Drawing Sheets

IMAGING MEMBER HAVING AN AMORPHOUS SILICON SURFACE LAYER

FIELD OF THE INVENTION

The present invention relates to a method for the formation of images by the electrophotographic process, and more particularly to a method for the formation of images by using an image-forming member having a surface-improving layer comprised principally of amorphous silicon and a particulate toner.

BACKGROUND OF THE INVENTION

It is well-known that in the formation of an image by the conventional electrophotographic process, the resolution and quality of the image obtained in the process depend closely upon the particle size of the toner used in the process. That is, a finest possible particles-having toner needs to be used in order to obtain a high-resolution, finely detailed image. For example, Japanese Patent Publication Open to Public Inspection (hereinafter referred to as Japanese Patent O.P.I. Publication No. 68047/1983 discloses a technique for the formation of an image by use of a toner containing more than 80% by weight particulate constituent whose particle size is not more than 10 μm. Also. Japanese Patent O.P.I. Publication No. 181362/1984 discloses a technique for the formation of an image by developing an electrostatic image formed on a CdS photoreceptor in accordance with the non-contact developing process with use of a particulate toner whose particle size is not more than 10 μm.

However, it is the present state that these image-forming methods using such particulate toners as mentioned above are unable to accomplish a practical reality because there is the following drawback to them:

That is, where such particulate toner is used, the toner tends to stick relatively fast to the surface of an image-forming member and, even when subjected to cleaning in the cleaning process, cannot be easily removed remains on the surface, thus deteriorating the electrophotographic characteristics of the image-forming member. The cause of such trouble is considered to be due to the fact that the smaller the particle size of the toner the more closely does the toner come into contact with and stick to the surface of the image-forming member where adhering force largely functions according to Van der Waals force and image force. etc., and further, part of the particulate toner passes under the cleaning blade so that it cannot be cleared off. Consequently, the residual toner covers all the surface of the image-forming member, thus deteriorating the characteristics thereof. Incidentally, those techniques for increasing the cleaning effect of such image-forming member have also been investigated.

For example. Japanese Patent O.P.I. Publication No. 176053/1985 discloses a technique to incorporate into a toner an amount of from 0.01 to 10% by weight metallic salts or a mixture thereof such as maleic acid metallic salts of zinc, magnesium, calcium. etc.; atearic acid metallic salts of zinc, cadmium, barium, lead, iron, nickel, cobalt, copper, aluminum, magnesium, etc.; dibasic lead stearate; oleic acid metallic salts of zinc, magnesium, iron, cobalt, copper, lead, calcium, etc.; palmitic acid metallic salts of aluminum, calcium, etc.; lead caprylate; lead caproate; linolic acid metallic salts of zinc, cobalt, etc.; calcium ricinolate; recinoleic acid metallic salts of zinc, cadmium, etc.; and the like. However, such techniques may be effective in those image-forming methods using a toner of a 10μ or larger particle size as described in the example of the above-mentioned publication, but, where an image is to be formed by using a developer comprised principally of a particulate toner having a particle size of not more than 10 μm for the purpose of accomplishing such a high quality image as mentioned above, is unable to provide adequate effect in the cleaning.

On the other hand, realization of an image-forming member (hereinafter referred to as merely 'photoreceptor') excellent in the cleanability has also been investigated. For example, Japanese Patent Examined Publication No. 35059/1985 describes a technique in which, in place of the conventional Se photoreceptor, CdS photoreceptor and OPC photoreceptor, a nonpollution photoreceptor is used which has an amorphous silicon (hereinafter referred to as a-Si) photosensitive layer excellent in the light resistance, corona-ion resistance and heat/moisture resistance as well as in the mechanical wear resistance, having a high hardness (having a Vickers hardness of from 1,000 to 1,200 as compared to the Se photosensitive layer having a Vickers hardness of 60). and the surface of which is covered with a resinous protective layer such as of polyethylene terephthalate, polycarbonate, polyethylene fluoride or the like so as to be improved to be more moisture-resistant, wear-resistant and cleanable. In the photoreceptor described in the foregoing publication, the reason why the excellent mechanical wear resistance-having a-Si photosensitive layer further has a protective layer thereon is as follows:

The a-Si that constitutes the foregoing photosensitive layer has the disadvantage that since it has in itself a Si-Si bonding-cut dangling bond, it has a lot of localized levels inside the energy gap to cause the thermal-excitation carrier to make hopping conduction and therefore the dark resistance is small, and besides, the photo-excitation carrier is trapped by the foregoing localized levels, so that the carrier is not allowed to exhibit its photoconductivity. Upon this, in order to provide a satisfactory photoconductivity, the publication proposes the formation of a photosensitive layer of a construction of a-Si:H, a-Si:X or a-Si:H:X made by combining a hydrogen atom (H) and/or a halogen atom (X) to fill the gap caused by the dangling bond. Such the photosensitive layer is excellent in the photoconductivity, but is poor in the dark resistance: its resistivity is from $10^8$ to $10^9$ Ωcm, which is only one 10,000th of that of a-Se. Also, the photosensitive layer tends to become affected during a long period of time by the air, moisture or chemical species due to corona discharge, and its receptive potential can be significantly lowered.

Hereupon, the photoreceptor having the a-Si layer described in the foregoing publication is so constructed as to have thereon further the afore-mentioned surface-improving layer (protective layer) comprised of an insulating resin. In addition, Japanese Patent Application No. 225646/1985 which was applied for earlier by the same applicant discloses a technique to improve both the mechanical strength and the durability of a photoreceptor having an a-Si layer by covering the surface thereof with a surface-improving layer having a thickness of 400 A to 5,000 A comprised of an insulating inorganic material such as $Al_2O_3$, $Ta_2O_5$, $CeO_2$, $ZrO_2$, $TiO_2$, MgO, ZnO, PbO, $MgF_2$, ZnS. or the like.

However, in the case where the formation of an image is made by using a particulate toner which is essential for accomplishing a high-quality image as mentioned above, the toner sticks so fast to the surface of the photoreceptor that the toner cannot be sufficiently removed by ordinary cleaning manner, thus necessarily requiring strong cleaning under a contact pressure several times as strong as that of the ordinary cleaning member. Thus, the resinous improving layer described in the foregoing Japanese Patent Examined Publication No. 35059/1985, when subjected to the above-mentioned strong cleaning, has its surface worn out and loses its improving function. Also, the above improving layer has the disadvantage that since it is an insulating layer, when the photoreceptor is exposed to light, its residual potential is large, tending to deteriorate the resulting image quality. The disadvantage of this kind may be found also in the photoreceptor having an improving layer comprised of the insulating inorganic material described in Japanese Patent Application No. 225646/1985.

SUMMARY OF THE INVENTION

It is an object of the present invention to provide a method for obtaining a high-resolution, high-quality copy image stably in accordance with the electrophotographic process.

The above object is accomplished by an image forming method comprising the steps of developing an electrostatic image formed on an image-forming member with a particulate toner for forming a toner image and transferring said toner image onto a receiving material, in which the image-forming member has a surface-improving layer comprised principally of amorphous silicon, and the toner has a weight average particle size within the range of from 1 μm to 6 μm and contains a constituent having a weight average particle size of not more than 5 μm which accounts for not less than 20% by weight of the whole amount of the toner.

DETAILED DESCRIPTION OF THE INVENTION

Figure 1:
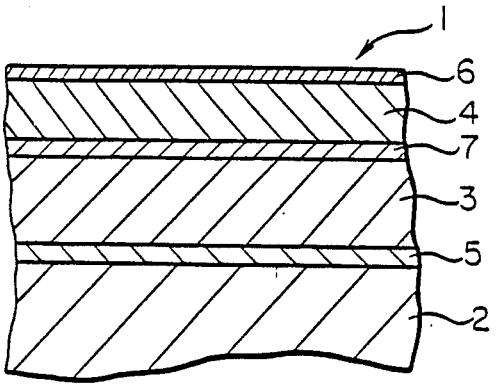
FIG. 1 is a cross-sectional view of the construction of the layers of the photoreceptor of this invention.

First, the photoreceptor to be used in this invention will be explained: As has been mentioned above, the a-Si layer has in itself a dangling bond therein and a lot of localized levels and therefore has no practical photoconductivity. However, by introducing a hydrogen atom (H) and/or a halogen (X) such as fluorine (F) into the a-Si layer to close the dangling bond, a satisfactory photoconductivity can be provided. Even the thus photoconductivity-provided a-Si:H(X) layer still has the disadvantage that its dark resistance is low, it lacks aptitude for environment, and the like, but if atoms such as of C, O, N, etc. are further introduced into the a-Si:H(X) layer, then the above disadvantage is removed, and besides, the characteristic necessary for electrophotography such as dark resistance is improved. This matter is described in, e.g., 'Phil. Mag. Vol. 35' (1978), and the photoreceptor of this invention is characterized, advancing the idea described in this publication a step forward, by having thereon a photoconductive thin layer as a surface-improving layer comprising a-Si which is largely improved on the following various characteristics by having atoms such as of C, O, N, etc. introduced thereinto.

That is, the photoreceptor of this invention is non-polluting and of the all-environment-adaptable type excellent in all the light resistance, corona-ion resistance and heat-moisture resistance, and in addition, the hardness of its surface-improving layer is as much high as in. e.g., Vickers hardness of 1,000 to 2,000, thus being pre-eminently excellent in mechanical strength. The reason why the mechanical strength of the surface-improving layer is so excellent may be probably because the a-Si layer is in itself excellent in the mechanical strength, and besides, the bonding between the Si atom and the atoms such as of C. N and O is much stronger than the bonding between the Si atoms. Accordingly, where the cleaning effect of the photoreceptor is enhanced, even if the cleaning member's contact pressure applied to the photoreceptor is, for example, 50 to 150 g/cm. the surface of the photoreceptor is enough to withstand this. Also, probably because the surface layer is so hard as has been mentioned. the rate of the transfer of the toner image formed on the photoreceptor onto a copying sheet is very excellent. The reason of this is considered because the surface layer of the photoreceptor is so hard that the surface energy is relatively lessened to reduce the adherence of the toner to the surface, thus leading to the increase in the efficiency of the image-transfer by static electricity onto a copying sheet. Besides, that the surface layer of the photoreceptor is so hard that the toner cannot eat into it is also advantageous. Thus, not only is the quality of the image on a copying sheet improved but also the residual toner in transit to the cleaning process is reduced, resulting in the increase in the cleaning efficiency.

As has been described above, the surface-improving layer of the photoreceptor of this invention has in itself an excellent photoconductivity and also has improving atoms (Y) such as C, O, and N introduced thereinto, whereby its dark resistance is increased to $10^{12}$ to $10^{13}$ Ωcm ($10^8$ to $10^9$ Ωcm a-Si:H) to thereby improve the charge retention on the surface of the photoreceptor, thus enabling the fundamental electrophotographic operation that the static charge provided on the surface of the photoreceptor is attenuated by being exposed to light to thereby form an electrostatic image. Further, the repetitive characteristics of charging and attenuation by light is stabilized, making possible the satisfactory reproduction of the potential characteristic even if the photoreceptor is allowed to stand over an extensive period of time (for example, more than one month).

The method for the formation of an image of this invention is characterized by using an extremely particulate toner having a weight average particle size of not more than 6 μm (particularly a toner containing not less than 20% by weight not more than 5 μm-size particles) and the foregoing excellent characteristics-having photoreceptor to thereby enable a high-resolution and finely detailed electrophotographic image whose resolving power is. e.g.. 9 to 12.5 lines/mm to always be obtained.

The surface-improving layer according to this invention exhibits excellent characteristics by containing at least one improving atoms (Y) such as C, O and N, but the improving atom or atoms may be contained either uniformly or not uniformly in the layer. When not uniformly contained, they should preferably be contained so that its content gradually increases from the plane in contact with the photosensitive layer toward the surface.

Such surface-improving layer is usually provided directly or, if necessary, through an intermediate layer, on the photosensitive layer, and examples of the photosensitive or photoconductive layer include a photosensitive layer prepared by dispersing an inorganic compound photoconductive material such as ZnO, $TiO_2$, CdS, HgS, or the like into a binder resin; a Se photosensitive layer containing an alloy comprising Te, As, or the like; an organic photosensitive layer containing a phthalocyanine-type pigment, azottype pigment or polycyclic quinone-type pigment and, if necessary, a charge-transfer material such as an aromatic amino compound; and the like. The above organic photosensitive layer is allowed to be functionally separated into two layers: a charge-generating layer and a charge-transfer layer. In this instance, the surface-improving layer is provided on the obverse-side layer (upper layer) of the two layers.

In this invention, however, the photosensitive layer is desirable to be a similar a-Si photosensitive layer for the reason that it can be prepared by using the same machine and the same materials as for the surface-improving layer, and in addition, the adherence between the photosensitive layer and the surface-improving layer and the surface nature of the surface-improving layer are easily controllable.

The characteristics of the photoreceptor of this invention will be illustrated by the typical example shown in FIG. 1:

In FIG. 1, indicated by 1 is an a-Si type electrophotographic photoreceptor. Photoreceptor 1 is of a construction comprising a drum-shaped conductive substrate 2 made of Al or the like having thereon a P+ type blocking layer 5, charge-transfer layer 3, intermediate layer 7, charge-generating layer 4, and surface-improving layer 6. Charge-blocking layer 5 comprises an a-Si:Y:H(X) which is heavy-doped with an element belonging to Group III A (e.g., B, Al, Ga) of the Periodic Table and which contains at least one of improving atoms (Y) such as C, O and N (for example, a-Si:C:H(X), a-Si:C:O:H(X), a-Si:N:H(X), a-Si:N:O:H(X), a-Si:O:H(X), a-Si:C:O:N:H(X), or the like). Charge-transfer layer 3 comprises an a-Si:Y:H(X) which is light-doped with an element belonging to Group III A of the Periodic Table and which contains at least one of improving atoms (Y) such as C, O and N in similar manner to the foregoing blocking layer 5. Intermediate layer 7 is not essential. If, however, this layer is to be provided, it comprises an a-Si:Y:H(X) containing at least one of the foregoing improving atoms (Y), and the improving atom (Y) content should be smaller than that of the foregoing charge-transfer layer 3. Charge-generating layer 4 comprises an a-Si:H(X) which, if necessary, is light-doped with an element belonging to Group III A of the Periodic Table. Surface-improving layer 6 comprises an a-Si:Y:H(X) of which the improving atom (Y) protects the underneath charge-generating layer 4 and is contained in an amount required for improving the characteristics of photoreceptor 1. Also, if necessary, a second intermediate layer may be provided between the charge-generating layer and the surface-improving layer. In this instance, the improving atom (Y) content should be smaller than that of the foregoing surface-improving layer 6.

The respective layers of photoreceptor 1 will be further detailed below:

Surface-improving layer 6 serves to protect the photoreceptor from being affected by moisture, air, ozone, etc., to thereby prevent its electric potential characteristic from being deteriorated with time, has a high-hardness surface enough to secure the mechanical wear resistance in the development, transfer and cleaning processes, and is so excellently heat-resistant as to enable the thermally adherent image-transfer. In order to provide such excellent characteristics to the photoreceptor, the foregoing surface-improving layer 6 is to contain one or a plurality of improving atoms (Y) such as C, O and N, and their content is as follows:

That is, the improving atom (Y) content, if it follows $Si+Y=100$ atm %, is 0.5 atm % $\leqq[Y]\leqq$ 90 atm %, and preferably 10 atm % $<$ 70 atm % (atm % is hereinafter referred to as merely %). The improving atom (Y) content being not less than 0.5% is desirable for the foregoing characteristics, results in the photoreceptor having a desired dark resistance value of $10^{12}$ to $10^{13}$ Ωcm, and makes the optical energy gap wider to thereby make the layer optically transparent to visible rays, exhibiting the so-called 'window' effect, thus enabling a sufficient amount of an incident light to reach the underneath photosensitive layer (charge-generating layer). If the improving atom (Y) content is less than 0.5%, it tends to allow defects such as mechanical damage to occur, and the photoreceptor becomes lacking in the dark resistance, and part of the incident light is absorbed by the surface-improving layer, thereby reducing the sensitivity of the photoreceptor.

If the improving atom (Y) content exceeds 90% the amount is so excessive as to lose the layer's semiconductor property, and also causes the layer-forming speed in the manufacture to lower to decrease the manufacturing efficiency. Accordingly, the Y content should be not more than 90%.

The thickness t of the surface-improving layer 6 (a-Si:Y:H layer) should be in the range of 400 A $\leqq t \leqq$ 1 μm, and preferably 400 A $\leqq t \leqq$ 5,000 A. Namely, if the thickness exceeds 1 μm, the residual potential becomes excessively high and also lower the photosensitivity to result in losing the satisfactory characteristics of photoreceptor 1. If the thickness is less than 400 A, the charge provided on photoreceptor 1 vanishes due to the tunnel effect, so that the photoreceptor is in the non-charged state, and it also causes the increase in the dark attenuation and the decrease in the photosensitivity.

Regarding the charge-generating layer 4, in order to improve its chargeability, the layer may have its resistance raised and be improved on the carrier transferability. To attain them. Boron atom may be introduced into charge-generating layer 4 to make the layer intrinsic. In this instance, at the time of glow discharge decomposition, $[B_2H_6]/[SiH_4]$ should be equal to 0.01 to 10 ppm by volume, and more preferably 0.05 to 5 ppm by volume, and most preferably 0.07 to 3 ppm by volume.

The thickness of the charge-generating layer should be from 2 to 15 μm. If the thickness is less than 2 μm. its photosensitivity is not enough, so that a light is liable to permeate into the underneath layer, while if it exceeds 15 μm. the residual potential rises, and thus the charge-generating layer is inadequate for practical use.

Intermediate layer 7 is provided for the purpose of raising the injection efficiency of carrier, and its composition should be of 0.01% $\leqq[Y]\leqq$ 40% more preferably 0.01% $\leqq[Y]\leqq$ 20%, and most preferably 0.01% $\leqq$ 15%.

However, the Y content is smaller than that of charge-transfer layer (preferably 1/6 to 5/6 of the Y content of charge-transfer layer).

This intermediate layer 7 should be light-doped with an element belonging to Group III A of the Periodic Table: for example, at the time of glow discharge decomposition. $[B_2H_6]/[SiH_4]$ should be equal to 0.1 to 100 ppm by volume, more preferably 0.05 to 50 ppm by volume, and most preferably 1 to 20 ppm by volume.

The thickness of intermediate layer 7 should be 0.01 to 2 μm. If the thickness is less than 0.01 μm. the layer's effect is weak, while if it exceeds 2 μm. on the contrary the sensitivity tends to be lowered. This intermediate layer is allowed to be formed in two or more layers.

As for the charge-transfer layer, in order to optimize its chargeability and sensitivity, the layer may be made intrinsic by introducing Boron atoms thereinto. The doping amount for making the layer intrinsic should be $[B^2H^6]/[SiH^4]=0.1$ to 100 ppm by volume, more preferably 0.5 to 50 ppm by volume, and most preferably 1 to 20 ppm by volume. The thickness of charge-transfer layer should be 5 to 50 μm. and preferably thicker than that of charge-generating layer. The composition of charge-transfer layer should be of $0.05\% \leqq [Y] \leqq 40\%$, more preferably $0.7\% \leqq [Y] \leqq 20\%$, and most preferably $0.8\% \leqq [Y] \leqq 15\%$.

The foregoing charge-blocking layer 5 sufficiently prevents the injection of electron from substrate 2 and, in order to improve the sensitivity and chargeability, is doped with an element belonging to Group III A of the Periodic Table by glow discharge decomposition thereby to be made P-type (further $P^+$-type) The doping amount should be, e.g.. $[B^2H^6]/[SiH^4]=10$ to 10,000 ppm by volume, more preferably 100 to 5,000 ppm by volume, and most preferably 500 to 3,000 ppm by volume.

The composition of charge-blocking layer 5 should be of $0.5\% \leqq [Y] \leqq 40\%$, more preferably $0.7\% \leqq [Y] \leqq 20\%$, and most preferably $0.8\% \leqq [Y] \leqq 15\%$.

The thickness of charge-blocking layer 5 should be 0.01 to 10 μm. If the thickness is less than 0.01 μm. its blocking effect is weak, while if it exceeds 10 μm, the charge-transferability tends to become deteriorated.

The above respective layers need to contain hydrogen or a halogen (such as fluorine). Particularly, the hydrogen content of charge-generating layer 3 is indispensable to compensate the dangling bond to improve the photoconductivity and charge-retainability, and should be preferably 10 to 30%. This content range is applicable also to surface-improving layer 6, intermediate layer 7, blocking layer 5 and charge-transfer layer 3. As the impurity to control the conductivity type, in addition to boron for making P type, the elements of Group III A of the Periodic Table such as Al, Ga, In and Tl may also be used.

The improving atom (Y) to be contained in the foregoing surface-improving layer is at least one of C, O and N as mentioned earlier, and the obtained layer may be any one of, e.g., a-Si:C:H(X), a-Si:C:O:H(X), a-Si:N:H(X), a-Si:N:O:H(X), a-Si:C:N:H(X). a-Si:C:N:O:H(X), and the like.

However, in the case where a C atom or N atom as the improving atom (Y) is contained, the composition, mentioned earlier, may be $0.5\% \leqq [C \text{ or } N] \leqq 90\%$, and preferably $10\% \leqq [C \text{ or } N] \leqq 70\%$, but if an O atom is contained, the composition should be $0.5\% \leqq [O] \leqq 70\%$, and preferably $5\% \leqq [O] \leqq 30\%$. And where all C, O and N are contained, the ratio of C:O:N should be 0 to 90: 0.5 to 70: 0 to 90, and as a whole they should be within the range of 0.5% to 90%.

Figure 2:
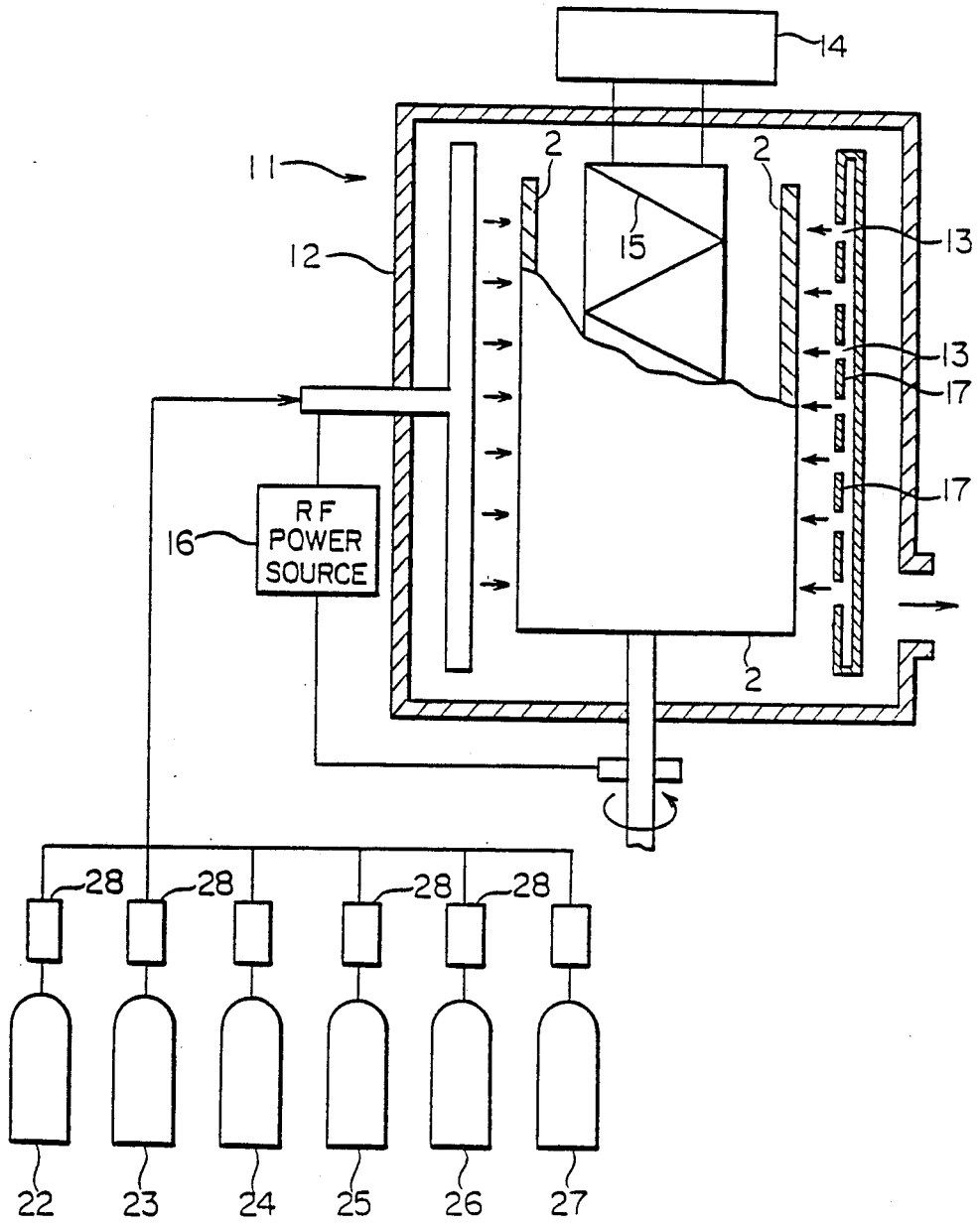
FIG. 2 is a cross-sectional view of the apparatus for producing the photoreceptor of this invention.

Subsequently, the manufacturing method and the apparatus therefor (glow discharger) of photoreceptor 1 (e.g., drum type) will be explained by FIG. 2.

A drum-type substrate 2 is rotatably set vertically inside a vacuum cabinet 12 of apparatus 11 which is so designed that substrate 2 can be heated to a specified temperature from the inside by a heater 15. A cylindrical high frequency electrode 17 with gas conduction holes 13 is arranged around and opposite to substrate 2, and glow discharge is generated between the electrode and the substrate by a high-frequency power supply 16. In the FIG. 22 is a supply source of $SiH_4$ or a gaseous silicon compound, 23 is a supply source of a hydrocarbon gas such as $CH_4$, 24 is a supply source of a nitrogen compound gas such as $N_2$, 25 is a supply source of an oxygenated compound gas such as $O_2$, 26 is a supply source of a carrier gas such as Ar, and 27 is a supply source of an impurity gas such as $B_2H_6$, and 28 represents the respective flowmeters for these supply sources. In this glow discharging apparatus, the surface of the support, e.g.. Al substrate 2, is first cleaned, and then arranged inside vacuum cabinet 12, and the gas pressure inside the vacuum cabinet is adjusted to $10^{-5}$ Torr by exhausting the gas inside, and substrate 2 is heated to and kept at a specified temperature, particularly 100° to 350° C., preferably 150° to 300° C. Subsequently, a highly pure inert gas is used as a carrier gas to conduct $SiH_4$ or a gaseous silicon compound, $CH_4$, $O_2$, etc. into vacuum cabinet 12, and a high-frequency voltage. e.g., 13.56 MHz. is impressed to the cabinet by high-frequency power supply 16 under a reaction pressure such as, e.g., 0.01 to 10 Torr. By doing this, the above respective reaction gases are decomposed by the glow discharge between electrode 17 and substrate 2, whereby $P^+$-type a-Si:C:H. i-type a-Si:C:H, i-type a-Si:C:H. a-Si:H, and a-Si:C:H are deposited superposedly as the foregoing layers 5, 3, 7, 4 and 6, namely, corresponding to the example of FIG. 1, on the substrate Z.

In the above manufacturing method, the temperature of substrate 2 in the process to form the a-Si-type layers on substrate 2 is specified to be 100° to 350° C., so that the layer quality, particularly electric property, of the photoreceptor can be improved.

In the formation of the respective layers of the above a-Si-type photoreceptor, in order to compensate the dangling bond, in place of or in combination with the above-mentioned H, a halogen atom, e.g., fluorine, may be introduced in the form of $SiF_4$ into these layers to thereby form a-Si:F, a-Si:H:F, a-Si:C:F, a-Si:C:H:F; a-Si:C:O:F, a-Ai:C:O:H:F, or the like. In this instance, the fluorine content is desirable to be 0.5 to 10%.

The above manufacturing method is based on the glow discharge decomposition process, but aside from this method, the above photoreceptor can also be produced by the spattering process, ion plating process, or a method in which Si is evaporated while conducting the hydrogen activated or ionized by a hydrogen discharge tube, such as the method disclosed in our Japanese Patent O.P.I. Publication No. 78413/1981 (Japanese Patent Application No. 152455/1979).

Also, in the photoreceptor according to this invention, as is described in. e.g.. Japanese Patent O.P.I. Publication No. 204048/1979, a surface-improving layer into which is incorporated at least one of improving atoms (Y) such as C, O, N so as to gradually increase during the course of forming the layer may be provided on the a-Si:H(X) photosensitive layer. For example, on the charge-generating layer 4 of FIG. 1 may be provided a surface-improving layer 6 in which improving atoms (Y) are gradually increased from 1% on the side of the charge-generating layer 4 toward 50% on the topmost surface side.

The foregoing a-Si:H(X) photoreceptor 1 is not necessarily for positive-charging use but may be for negative-charging use. In this instance, however, the doping agent to be introduced into the respective layers constituting the photoreceptor may be an element belonging to Group V A. such as P. As, Sb, Bi, in lieu of that of Group III A, such as B. Al, Ga, In, of the Periodic Table. Incidentally, providing the foregoing intermediate layer 7 and blocking layer 5 to photoreceptor 1 is not an essential requirement.

Also, the photosensitive layer of photoreceptor 1, instead of being of the functionally separated type comprised of charge-generating layer 4 and charge-transfer layer 3, may be a single photoconductive layer having both functions. In addition, the photosensitive layer of photoreceptor 1 may also be an organic photosensitive layer, selenium-type photosensitive layer, or a photosensitive layer having CdS or ZnO dispersed into its binder resin.

The foregoing substrate 2 of photoreceptor 1 according to this invention may be either conductive or insulating. As the conductive substrate, metals such as, for example, stainless steel, Al, Cr, Mo, Ir, Nb, Te, V, Ti, Pt, Pd, etc., and alloys of these metals may be used. As the electrically insulating substrate, materials including film or sheet-form synthetic resins such as, e.g., polyester, polyethylene, polycarbonate, cellulose triacetate, polypropylene, polyvinyl chloride, polyvinylidene chloride, polystyrene, polyamide, etc., and glass, ceramic, paper, and the like may be generally used. Such the electrically insulating substrate material, when used, is desirable to have at least one side thereof treated to be conductive.

For example, the substrate, if made of glass, should have its surface treated to be conductive with use of $In_2O_3$, $SnO_2$, etc., or, if made of a synthetic resin such as polyester film, etc., should have its surface treated to be conductive by being subjected to vacuum deposition treatment, electron beam deposition treatment or spattering treatment with use of metals such as Al, Ag, Pb, Zn, Ni, Au, Cr, Mo, Ir, Nb, Ta, V, Ti, Pt, etc, or by being laminated with these metals. The substrate may be in any discretional form such as a cylindrical, belt, plate or the like form. The form can be determined as desired, but, in the case of a high-speed continuous copying, is desirable to be in the endless belt form or cylindrical form.

The thickness of the substrate may be arbitrarily determined so that an image-forming member can be formed as desired, but, where the image-forming member is required to be elastic, the substrate may be as much thin as possible as long as the thickness is within the range allowing it to sufficiently function as the substrate. However, in such the case, the thickness is usually not less than 10 μm from the standpoint of the manufacture and handling of the support or the mechanical strength of the same.

Examples of the toner for use in the method for the image formation according to this invention include magnetic or nonmagnetic insulating toners having a volume resistivity of not less than $10^{12}$ Ωcm and conductive toners having a volume resistivity of less than $10^{12}$ Ωcm. Developers using such toners include one-component developers comprised principally of the above-mentioned toner and two-component developers comprised of such the toner in combination with a carrier. However, in any of these various toners, their weight average particle size is required to be not more than 6 μm, and preferably not less than 1 μ, and they are preferably required to contain those particles having an weight average particle size of not more than 5 μm accounting for 20% by weight of the whole toner. If the toner has a weight average particle size of exceeding 6 μm and contains those toner particles whose weight average particle size of not more than 5 μm accounting for less than 20% by weight of the whole toner, the toner is unable to give any such desirable image as having a resolving power of more than. e.g., 9 lines/mm, while if the weight average particle size is less than 1 μm. there occurs the trouble that the resulting image is poor in the density and tends to be fogged.

The foregoing insulating toner can be obtained in the manner that a not more than 15% by weight coloring agent and, if necessary, a not more than 5% by weight charge-control agent are mixed into a thermoplastic or thermosetting binder resin, and the mixture is molten, kneaded, cooled and then pulverized, and further classified so as to be of the foregoing particle size. The obtained toner may also be further heat-treated thereby to be a spheric particles-having toner. Alternatively, a coloring agent and other additives may be incorporated into a binder resin monomer, and the monomer is polymerized to be in the particulate form under a stirring condition to thereby obtain a spheric particles-having toner. Examples of the binder resin for use in producing the above toner include addition-polymerization-type resins such as styrene resin, styrene-acryl resin, polyester resin, styrene-butadiene resin, acryl resin, etc., condensation-polymerization-type resins such as polyamide resin, polysulfonate resin, polyurethane resin, etc., and epoxy resin, and the like.

Monomers for use in the formation of the addition-polymerization resins of these resins mentioned above include styrenes such as styrene, o-methylstyrene, m-methylstyrene, p-methylstyrene, 3,4-dichlorostyrene, etc.; ethylene-type unsaturated monoolefins such as ethylene, propylene, butylene, isobutylene, etc.; halogenated vinyls such as vinyl chloride, vinylidene chloride, vinyl bromide, vinyl fluoride, etc.; vinyl esters such as vinyl acetate, vinyl propionate, vinyl benzoate, etc.; α-methylene-aliphatic-monocarboxylic esters such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, n-octyl methacrylate, dodecyl methacrylate, lauryl methacrylate, 2-ethylhexyl methacrylate, stearyl methacrylate, phenyl methacrylate, dimethylaminoethyl methacrylate, diethylaminoethyl methacrylate, etc.; acrylic acid or methacrylic acid derivatives such as acrylonitrile, methacrylonitrile, acrylamide, etc.; vinyl ethers such as vinyl-methyl ether, vinyl-ethyl ether, vinyl-isobutyl ether, etc.; vinyl ketones such as vinyl-methyl ketone, vinyl-hexyl ketone, methyl-isopropenyl ketone, etc.; N-vinyl compounds such as N-vinyl-pyrrole, N-vinylcarbazole, N-vinyl-indole, N-vinyl-pyrrolidone, etc.; monoolefin-type monomers such as vinylnaphthalenes; and diolefin-type monomers such as propadiene, butadiene, isoprene, chloroprene, pentadiene, hexadiene, etc.

These monomers may be used alone or in combination of two or more of them.

Monomers for use in the formation of the foregoing condensation-polymerization-type resins include ethylene glycol, triethylene glycol, 1,3-propylene glycol, and the like.

Examples of the afore-mentioned coloring agent to be contained in the toner include carbon black, aniline black, furnace black, lump black, phthalocyanine blue, methylene blue, victoria blue, aniline blue, ultramarine blue, auramine, chrome yellow, quinoline yellow, hansa yellow, rhodamine B, rosebengal, alizarin lake, and the like. Examples of the charge-control agent which is used at need include those positive-charge control agents comprising electron-donating group-having dyes, pigments and other amine derivatives and those negative-charge control agents comprising electron-attractive group-having dyes, pigments and other organic compounds having a cyano group, halogen atom, nitro group, etc.

Examples of the magnetic material to be used in the case where the foregoing insulating toner is a magnetic toner include those materials which are very strongly magnetized by the magnetic field in the direction thereof, for example, metals such as iron, cobalt, nickel, etc.; alloys or compounds containing ferromagnetism-showing elements such as iron, cobalt, nickel, etc., typified by ferrite, magnetite, hematite, and the like,: and alloys not containing ferromagnetic elements but tending to show ferromagnetism by being appropriately heat-treated. e.g.. manganese-copper-containing Heusler's alloy such as manganese-copper-aluminum alloy or manganese-copper-tin alloy: and chromium dioxide; and the like, and a particulate powder comprised of any of these materials having particle sizes of 0.05 to 3 $\mu$m may be contained in an amount of 5 to 70% by weight in the toner.

In many cases, the foregoing insulating toner is mixed with a magnetic carrier and used as a two-component developer. The reason is because the two-component developer has the advantage of its fluidity and triboelectric chargeability being easily controllable and of being excellent in the developability. The above magnetic carrier is one prepared by dispersing the magnetic particulate powder used for the aforementioned toner in a quantity of 20 to 300% by weight, preferably 50 to 150% by weight, into the same binder resin as used in the foregoing toner, and its weight average particle size is 5 to 80 $\mu$m, and preferably 5 to 40 $\mu$m.

The above magnetic carrier may be comprised of the above particle size-having magnetic material alone or may be a coated carrier having its surface coated with a resin. Such the magnetic carrier should be of a resistivity of not less than $10^8$ $\Omega$cm, preferably not less than $10^{13}$ $\Omega$cm and more preferably not less than $10^{14}$ $\Omega$cm in order to get rid of the shortcoming that a charge is injected by bias voltage into the carrier to thereby cause the carrier to adhere to the surface of the photoreceptor, or bias voltage leaks out through the carrier to erase the latent image charge.

The resistivity of the carrier (or toner) can be found in the manner that its particles are put into a tapped container having a cross-sectional area of 0.5 $cm^2$, a load of 1 $kg/cm^3$ is applied onto the stuffed particles, then a voltage is impressed between the load and the bottom electrode so as to generate an electric field of $10^2$ to $10^5$ V/cm, and the reading of the electric current at the moment is taken in a specified calculation for the resistivity. In this instance, the thickness of the stuffed particles' stratum of the carrier (or toner) is about 1 mm. Further, the above-mentioned resin-coated carrier or resin-dispersed carrier particles are desirable to be made spherical in order to improve the fluidity of the developer which uses the carrier, also to improve the triboelectric chargeability the carrier and the toner, and to make the blocking hard to occur between the carrier particles or between the carrier and the toner.

Such the spherical particles-having carrier, in the case of, e.g., the resin-coated carrier, can be obtained by coating with a resin the surface of in advance spherically shaped magnetic particles, and, in the case of the resin-dispersed carrier, can be obtained by heat-treating the dispersed particles obtained by dispersing magnetic particulate powder into a resin or by directly preparing spherical particles in accordance with the spray-dry process.

The foregoing two-component developer can be prepared by mixing the above-mentioned carrier and toner in the ratio by weight of 97 to 85: 3 to 15, and, if necessary, by adding thereto 0.1 to 1.0% by weight to the toner of a fluidizing agent such as hydrophobic silica, colloidal silica or silicone varnish and a cleaning aid such as a fatty acid metallic salt, fluorine-type surface active agent, etc., and in addition an antioffset agent such as a low molecular weight polyalkylene, and the like.

The nonmagnetic insulating toner to be used in the one-component or two-component developer is allowed to be a pressure-fixation toner comprised of an adhesive component whose binder resin is soft and a hard high-molecular component. Such the pressure-fixation toner can be obtained in similar manner to that of the foregoing insulating toner; i.e., a coloring agent and other additives are added to the toner, and the mixture is molten, kneaded, cooled, pulverized and then classified, but more preferably it should be in the form of a capsule toner which can be obtained by coating the core material consisting of a soft component containing a coloring agent and other additives with a hard high-molecular polymer. In obtaining such the capsule toner, for example, the in situ polymerization method is used. That is, a core material is in advance prepared by the foregoing melting, kneading, cooling and pulverizing, and the prepared core material is dispersed into a solvent containing a vinyl monomer for capsule-coating use and polymerization initiator, and then this dispersed liquid is suspension-polymerized in water with stirring, thereby obtaining a capsule toner.

Example of the adhesive component for use in the preparation of the above capsule toner include higher fatty acids such as stearic acid, palmitic acid, myristic acid, lauric acid, capric acid, etc.; higher fatty acid metal salts such as aluminum stearate, lead stearate, barium stearate, magnesium stearate, zinc stearate, zinc palmitate, etc.; higher fatty acid derivatives such as hydrogenated caster oil, cocoa butter, methylhydroxy stearate, glycerol-monohydroxy stearate, etc.; higher fatty acid amides such as octadecaneamide, hexadecaneamide, tetradecaneamide, dodecaneamide, decaneamide, octaneamide, hexaneamide, etc.: waxes such as beeswax, carnauba wax, microcrystalline wax, etc.; rosin derivatives such as rosin, hydrogenated rosin, rosin esters, etc.: condensation-type polymers such as drying oil-type or semi-drying oil-type alkyd, rosin-modified alkyd, phenol-modified alkyd, styrenated alkyd, epoxy-modified phenol resin, natural resin-modified phenol resin, amino resin, silicone resin, polyurethane, urea resin, polyesters, etc.; polyolefins such as acrylic acid—long-chain alkyl acrylate copolymerization oligomer, acrylic acid-long-chain alkyl methacrylate copolymerization oligomer, methacrylic acid-long-chain alkyl acrylate copolymerization oligomer, methacrylic acid-long-chain alkyl methacrylate copolymerization oligomer, styrene-long-chain alkyl acrylate copolymerization oligomer, styrene-long-chain alkyl methacrylate copolymerization oligomer, polyethylene, etc.; waxes such as polyethylene oxide, paraffin, higher alcohols, etc.; ethylene-vinyl acetate copolymer, ethylene-vinyl-alkyl ether copolymers, maleic anhydride-type copolymers; petroleum-type residues such as asphalt, gilsonite, etc.; rubbers such as isobutylene rubber, styrene-butadiene rubber, nitrile rubber, chlorinated rubber, etc.: and the like.

As the capsule agent for the above capsule toner, those binder resins or their monomers for use in forming the foregoing insulating toner may be used.

The toner to be used in the foregoing one-component or two-component developer may be a magnetic or nonmagnetic conductive toner. Such the conductive toner may be formed by coating the surface of the foregoing insulating toner or capsule toner with a conductivity-providing agent such as, e.g., carbon black, metal powder, magnetic powder, quaternary ammonium salt, copper iodide, tin iodide, indium oxide, indium-tin oxide, conductive zinc oxide, conductive titanium oxide, or the like, and its volume resistivity is less than $10^{13}$ Ωcm.

The 'particle size' of the toner and carrier herein means a weight average particle size which is a value measured by a 'Coltercounter' manufactured by Colter Co.

Figure 3:
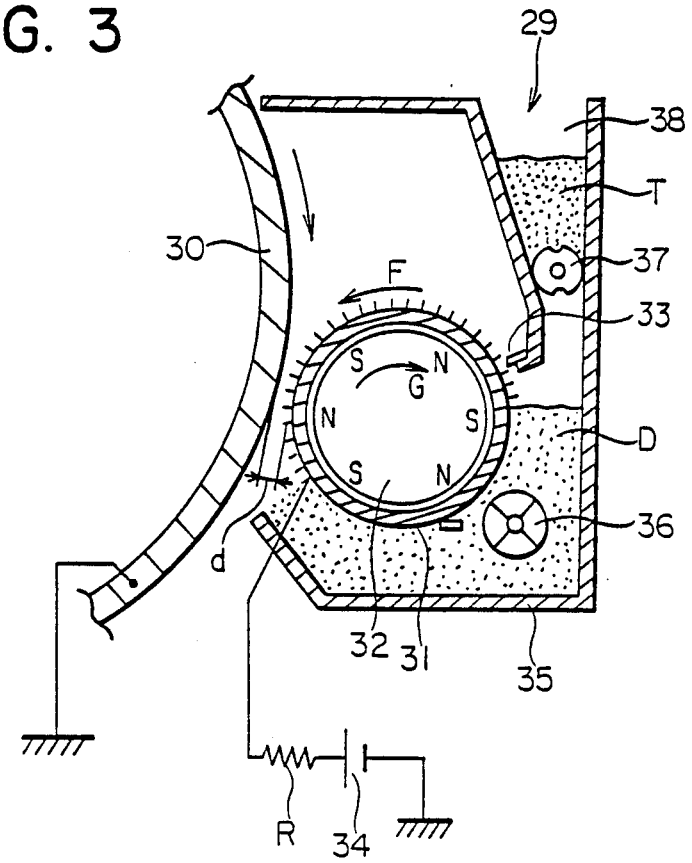
FIG. 3 is a cross-sectional view of a typical developing device for developing the photoreceptor of this invention.

The method for the formation of an image by using the developer containing the foregoing particulate toner of this invention and using the foregoing surface-improving layer having photoreceptor of this invention is such that an imagewise exposure corresponding to an original image is first made to form an electrostatic image on the foregoing image-forming photoreceptor 30 of FIG. 3, and the electrostatic image is then developed by, e.g., a magnetic brush developing device 29, to thereby form a toner image. This toner image is then transferred electrostatically onto a copying sheet that has been sent in timely with the image-forming process from a copying paper feeder and then thermally fixed by a heat roll. Where the above toner is a capsule toner, after being electrostatically transferred, the toner image may be fixed under pressure (if necessary, in combination with heat), and if the above toner is a conductive toner, the toner image is pressed to be transferred by a pressing force of 10 kg/cm onto a copying sheet and then fixed by a heat roller. The photoreceptor, after the image transfer, is strongly cleaned by a cleaning brush, cleaning blade or magnetic brush under a contact pressure of, e.g., 50 to 150 g/cm, thereby to be ready for the subsequent image formation.

In the developing device 29 of FIG. 1, 30 is a photoreceptor, 31 is a nonmagnetic sleeve made of Al or brass which rotates in the direction of arrow F, and 32 is a magnetic roller having a plurality of N,S-alternate electrodes and rotates in the direction of arrow G. 33 is a developer stratum's thickness regulating member that regulates the amount of the developer to be transported on the foregoing sleeve 31, and 34 is a DC power supply to impress a bias voltage of, e.g., 50 to 500 V between photoreceptor 30 and sleeve 31. 35 is a developer bath, and 36 is a stirrer to mix, with stirring, the developer D inside the developer bath, and 37 is a toner-replenishing roller to replenish a specified quantity of the toner T inside the hopper 38 into the developer bath 35. R is a bias-adjusting resistance, and d is a gap between photoreceptor 30 and sleeve 31 in the developing region and is desirable to be in the range of 100 to 2,000 μm in the case of the developer using the particulate toner of this invention. In addition, the developing device 29 according to this invention is not only limited to a magnetic brush-developing device but may also be a cascade-developing or spray-developing device.

EXAMPLES

The present invention will be illustrated more in detail by the following examples, but the embodiment of this invention is not limited to and by the examples.

First, the developer to be used in the examples is as follows: Toners:

| | |
|---|---|
| Polyester resin Dialec MB/SC (produced by Diamond Shamrock Co.) | 100 parts by wt |
| Carbon black | 8 parts by wt |
| Polypropylene (M.P. 120° C.) | 2 parts by wt |

The above materials were sufficiently mixed over 5 hours and then kneaded by two rollers heated at 170° C. The kneaded mixture, after being naturally cooled, was roughly pulverized by a cutter mill, and then finely pulverized by a pulverizer using a jet air stream, and further classified by a wind classifier, whereby 4 toners having weight average particle sizes of 4.0 μm. 5.0 μm, 7.0 μm and 10.0 μm as shown in the accompanying table were obtained. These toners were each mixed with a magnetic carrier produced in the following manner in the mixing ratio by weight of 90 (carrier): 10 (toner). whereby 4 developers were prepared and provided for the examples of this invention.

Carriers:

Five parts by weight of styrene-methyl methacrylate (1:1) copolymer resin were dissolved into 100 ml of toluene, this solution were mixed with 100 g of ferrite particles having an average particle size of 30 μm, and this mixture was sprayed and dried by the spray dry process to thereby obtain a resin-coated carrier.

Subsequently, the photoreceptor to be used in the examples of this invention is as follows:

An electrophotographic photoreceptor as show in FIG. 1 was prepared on a drum-type Al support by the glow discharge decomposition method: Namely, a smooth surface-having drum type Al substrate 2, after cleaning its surface, was arranged inside the vacuum cabinet 11 of FIG. 2, the gas pressure inside the vacuum cabinet 11 was adjusted by exhausting to $10^{-6}$ Torr, and the substrate 2 was heated to and kept at particularly 100° to 350° C., preferably 150° to 300° C. After that, a highly pure Ar gas was conducted as a carrier gas into the cabinet, and under a back pressure of 0.5 Torr a high-frequency power having a frequency of 13.56 MHz was impressed and a 10-minute preliminary discharge took place. And then, a reaction gas comprised of $SiH_4$, $CH_4$ and $B_2H_6$ was conducted into the cabinet and the thereby formed mixture gas, Ar+-$SiH_4$+$CH_4$+$B_2H_6$, in the flow ratio of $1:1:1:1.5\times10^{-3}$ was subjected to glow discharge decomposition, whereby a charge-blocking function-having P+-type a-Si:C:H layer 5, an a-Si:C:H charge-transfer layer (wherein $[B_2H_6]/[SiH_4]=10$ ppm by volume, $[C]=10\%$) 3, and an a-Si:C:H intermediate layer (wherein $[B_2H_6]/[SiH_4]=9$ ppm by volume. $[C]=5\%$)

-continued

| | |
|---|---|
| no stains nor scratches were found | A |

TABLE

| | Photoreceptor | | | | | | | | Toner | | | | |
|---|---|---|---|---|---|---|---|---|---|---|---|---|---|
| | Surface-improving layer | | | | | | | | | | Image evaluation | | |
| | Improving atom (atm %) | | | Thickness | Blocking layer thick. | Charge-transfer layer | Intermediate layer | Charge-generating layer | Weight average particle | Not more than 5 μm toner content | Resolving power | Image quality | Durability |
| No. | C | O | N | μm | μm | thick. μm | thick. μm | thick. μm | size μm | % by wt | line/mm | Blur | |
| EXAMPLE | | | | | | | | | | | | | |
| 1 | 60 | — | — | 0.10 | 1.0 | 14.0 | 0.05 | 5.0 | 4.5 | 70 | 11.0 | A | A |
| 2 | — | 60 | — | " | " | " | " | " | " | " | " | A | A |
| 3 | — | — | 60 | " | " | " | " | " | " | " | 11.5 | A | A |
| 4 | 30 | 30 | — | 0.15 | " | 13.0 | " | " | 5.0 | 65 | 10 | A | A |
| 5 | — | " | 30 | " | " | " | 0.06 | " | " | " | " | A | A |
| 6 | 30 | 0.5 | " | " | 1.5 | " | " | 7.0 | " | " | " | A | A |
| 7 | 20 | 20 | 20 | " | " | 13.5 | " | " | 5.5 | 40 | 9.5 | A | A |
| 8 | 90 | — | — | 0.10 | " | " | " | " | " | " | " | B*1 | A |
| 9 | 10 | — | — | " | " | " | 0.04 | " | " | " | " | A | A |
| 10 | — | 60 | — | " | " | " | " | 6.5 | 3.0 | 80 | 12 | A | A |
| 11 | — | " | — | " | " | " | " | " | " | " | 12.5 | A | A |
| COM | | | | | | | | | | | | | |
| 1 | — | " | — | " | 1.0 | 14.0 | 0.06 | 5.0 | 7.0 | 30 | 6 | B | A |
| 2 | — | " | — | " | " | " | " | " | 10.0 | 10 | " | B | A |
| 3 | — | — | — | — | " | " | " | " | " | " | " | C*2 | C |

Note:
'COM' = Comparative examples.
*1Slightly fogged.
*2Image blur appears.

7 were in order formed at the depositing rate of 6 μm/hr in the thicknesses given in the accompanying table. Subsequently, the supply of the gas such as $CH_4$ was stopped, and the $S:H_4$ and $B_2H_6$ were discharge-decomposed to thereby form an a-Si:H charge-generating layer (wherein $[B_2H_6]/SiH_4]=0.1$ ppm by volume) 4 in the thicknesses given in the accompanying table. Next, an improving gas such as $O_2$, $CH_4$ and/or $N_2$ was discharge-decomposed while being conducted into the cabinet 11 so as to be of the contents given in the accompanying table to thereby form a surface-improving layer 6 having the thicknesses described in the table. Thus, different photoreceptor samples for this invention were prepared, and further 3 different comparative photoreceptor samples as shown in the table were prepared.

The four developers prepared previously and the 15 photoreceptors were used in combination to hold a test of forming 14 images by using a U-Bix 16OOMR copying apparatus, manufactured by Konishiroku Photo Industry Co., Ltd., of which its own selenium photoreceptor was replaced by these a-Si photoreceptors. The resulting images were evaluated in accordance with the following conditions:

Evaluating Conditions (1) Resolving power: A resolution test chart was copied, and the resolved number of lines per mm was judged by eye.

| (2) Image blur: When 5.5-point English characters are | |
|---|---|
| illegible | C |
| barely legible | B |
| clearly legible | A |
| (3) Durability: After making 20,000 copies, | |
| a lot of scratches and stains appeared | C |
| scratch trouble was found in 1-10 places | B |
| no stains nor scratches were found | A |

From the results given in the table, it is apparent that any of the images obtained in the examples where the image formation was made by using the photoreceptors and developers according to this invention is excellent in the image quality as well as in the resolution, and even where the image copying was repeated, the image is stable and not deteriorated. In contrast, in the comparative examples, the samples show inferiority in the image quality as well as in the resolution, and in the course of repeating the copying operation, a lot of scratches and deterioration of the image quality were found.

What is claimed is:

1. An image forming member for use in an electrophotographic process, comprising:

a substrate;

a photoconductive layer disposed on the substrate for generating an electrical charge in response to light incident thereon; and a surface improving layer disposed on the photoconductive layer for protecting the photoconductive layer, said surface improving layer comprising amorphous silicon (Si) including one or more improving atoms (Y) chosen from the group of: C, O, and N, and satisfying the following relation:

$$Si+Y=100 \text{ atm } \%$$

$$0.5 \text{ atm } \% \leqq [Y] \leqq 90 \text{ atm } \%$$

2. An image forming member as claimed in claim 1, wherein said improving atom (Y) is C at a concentration of 60 atm % and the thickness of said surface improving layer is substantially 0.10 μm.

3. An image forming member as claimed in claim 1, wherein said improving atom (Y) is O at a concentration of 60 atm % and the thickness of said surface improving layer is substantially 0.10 μm.

4. An image forming member as claimed in claim 1, wherein said improving atoms (Y) is N at a concentration of 60 atm % and the thickness of said surface improving layer is substantially 0.10 μm.

5. An image forming member as claimed in claim 1, wherein said improving atoms (Y) are C and O, each at concentrations of 30 atm %, and the thickness of said surface improving layer is substantially 0.15 μm.

6. An image forming member as claimed in claim 1, wherein said improving atoms (Y) are O and N, each at a concentration of 30 atm %, and the thickness of said surface improving layer is substantially 0.15 μm.

7. An image forming member as claimed in claim 1, wherein said improving atoms (Y) are C, O, and N, at concentrations of 30 atm %, 0.5 atm %, and 30 atm %, respectively, and the thickness of said surface improving layer is substantially 0.15 μm.

8. An image forming member as claimed in claim 1, wherein said improving atoms (Y) are C, O, and N, each at concentrations of 20 atm %, and the thickness of said surface improving layer is substantially 0.15 μm.

9. An image forming member as claimed in claim 1, wherein said improving atom (Y) is C at a concentration of 90 atm %, and the thickness of said surface improving layer is substantially 0.10 μm.

10. An image forming member as claimed in claim 1, wherein said improving atom (Y) is C at a concentration of 10 atm %, and the thickness of said surface improving layer is substantially 0.10 μm 11. An image forming member as claimed in claim 1, wherein said improving atom (Y) is O at a concentration of 60 atm %, and the thickness of said surface improving layer is substantially 0.10 μm.

12. An image forming member as claimed in claim 1, wherein the thickness of the surface improving layer is on the order of 100 A to 1 μm.

13. An image forming member as claimed in claim 1, further including an intermediate layer disposed on the charge transfer layer to improve the carrier injection efficiency of said charge transfer layer.

14. An image forming member as claimed in claim 1, wherein said photosensitive layer is comprised of an organic material and includes a charge transfer layer disposed on the substrate and a charge generating layer disposed on the intermediate layer to generate a charge in response to light photons incident thereon.

15. An image forming member as claimed in claim 1, further including a charge blocking layer disposed on the substrate for preventing the flow of carriers from the substrate into the photoconductive layer.

16. An image forming member as claimed in claim 1, wherein said substrate is of a conductive material chosen from the group of: stainless steel, Al, Cr, Mo, Ir, Nb, Te, V, Ti, Pt, and Pd.

17. An image forming member as claimed in claim 1, wherein said substrate is electrically insulating having an electrically conductive material disposed thereon.

18. An image forming member as claimed in claim 17, wherein said substrate is chosen from the group of: polyester, polyethylene, polycarbonate, cellulose triacetate, polypropylene, polyvinyl chloride, polyvinylidene chloride, polystyrene, polyamide, glass, ceramic, or paper.

19. An image forming member as claimed in claim 15, said charge blocking layer comprising a-Si:Y:H(X) which is heavy-doped with an element chosen from the group of: B, Al, Ga, said charge blocking layer further including at least one improving atom chosen from the group of: C, O, and N.

20. An image forming member as claimed in claim 14, wherein said charge transfer layer comprises a-Si:Y:H(X) and is heavy-doped with an element chosen from the group of: B, Al, and Ga, said charge transfer layer further including an improving atom chosen from the group of: C, O, and N.

21. An image forming member as claimed in claim 20, wherein said intermediate layer comprises a layer of a-Si:Y:H(X), including at least one improvement atoms chosen from the group of: C, O, and N, wherein the improvement atom content in the intermediate layer is smaller than the improvement atom content in the charge-transfer layer.

22. An image forming member as claimed in claim 14, wherein said charge generating layer comprises a-Si:H(X) which is light-doped with and element chosen from the group of B, Al, and Ga.

23. An image forming member as claimed in claim 14, further including a second intermediate layer disposed between the charge generating layer and the surface improving layer.

24. An electrophotographic apparatus, comprising:

(A) an image forming member, including:

(i) a substrate;

(ii) a photoconductive layer disposed on the substrate for generating an electrical charge in response to light incident thereon; and (iii) a surface improving layer disposed on the photoconductive layer for protecting the photoconductive layer, said surface improving layer comprising amorphous silicon (Si) including one or more improving atoms (Y) chosen from the group of: C, O, and N, and satisfying the following relation:

$$Si+Y=100 \text{ atm } \%$$

$$0.5 \text{ atm } \% \leqq [Y] \leqq 90 \text{ atm } \%$$

(B) a toner having a weight average particle size within the range of from 1 μm to 6 μm and containing a constituent having a weight average particle size of not more than 5 μm which accounts for not less than 20% by weight of the whole amount of said toner; and (C) means to transfer said toner onto said image forming member.

* * * * *

UNITED STATES PATENT AND TRADEMARK OFFICE

CERTIFICATE OF CORRECTION

PATENT NO. : 4,868,078

DATED : September 19, 1989

INVENTOR(S) : Eiichi Sakai et al.

It is certified that error appears in the above-identified patent and that said Letters Patent is hereby corrected as shown below:

Claim 21, column 18, line 21, change "improvement" to --improving atom--.

Claim 21, column 18, line 23, change "improvement atom" to --improving atom--.

Claim 22, column 18, line 28, change "and" to --an--.

Signed and Sealed this

Ninth Day of July, 1991

*Attest:*

*Attesting Officer*

HARRY F. MANBECK, JR.

*Commissioner of Patents and Trademarks*